US005089670A

United States Patent [19]

Chen

[11] Patent Number: 5,089,670

[45] Date of Patent: Feb. 18, 1992

[54] STRUCTURE OF SOCKET SWITCH

[76] Inventor: Chien-Jen Chen, 7th Fl. 473 Min Chuan E. Rd., Taipei, Taiwan

[21] Appl. No.: 571,702

[22] Filed: Aug. 24, 1990

[51] Int. Cl.[5] ..... H01H 9/00; H01H 19/00; H01H 33/96

[52] U.S. Cl. ..... 200/1 A; 200/6 B; 200/51.09; 200/51.1

[58] Field of Search ..... 200/1 A, 6 R, 5 R, 6 B, 200/6 BB, 51.02, 51.03, 51.04, 51.05, 51.06, 51.07, 51.08, 51.09, 51.1, 51.11, 51.12, 50 B, 51 R

[56] References Cited

U.S. PATENT DOCUMENTS 3,980,370 9/1976 Hernandez ..... 200/51.09
4,596,908 6/1986 Mott ..... 200/51.09

*Primary Examiner*—Harold Broome

*Attorney, Agent, or Firm*—Morton J. Rosenberg; David I. Klein

[57] ABSTRACT

An improved structure of a socket switch is provided which includes a body housing (11), a contact point housing (12), and a rear clamping member (13). The contact point housing (12) has an internal chamber (15) on a bottom end and a substantially triangularly shaped switch member (14) having a shaft member (21) extending from opposing sides is insertable within a groove (19) of the contact point housing (12). The triangularly contoured switch member (14) has a first apex which is located in the path of an insertable plug for rotation of a second apex member from a first position to a second position to allow switching from a second contact member and first contact members (17, 18) to a second position where a third contact member (16) is contacted by the second contact member (17). The contact point housing (12) has a pair of pintle hooks (20) which secure the rear clamping member within the internal chamber (15).

1 Claim, 3 Drawing Sheets

STRUCTURE OF SOCKET SWITCH

BACKGROUND OF THE INVENTION

The subject invention is directed to an improved structure of a single component socket switch. The subject invention relates to providing a simplified and structurally secure solid socket switch for increasing sensitivity of the contact points of the electrical switch.

Additionally, the subject socket switch is adapted to be installed on AC/DC switching power supply systems. In particular, the subject invention is directed to a socket switch where upon insertion of an AC power supply, switching mechanisms connect the AC power by means of displacement of the position of internal contact point terminals with a removal of the original DC power supply. Further, the subject invention directs itself to a socket switch where upon removal of an AC plug from internal the socket switch, the original DC power supply is automatically reinstated. Thus, this invention directs itself to a socket switch where AC or DC power is automatically applied responsive to the insertion or removal of an AC plug.

PRIOR ART

Prior art conventional socket switches have a number of shortcomings in their manufacture, as well as use. Generally, in some prior art sockets, a fixed groove is formed on the body of such socket switches in relation to the thickness and width of metal laminate contact points. In the switching of contact points of such prior systems, the insertion of the AC plug displaces an insulating convex seat which is in contiguous contact with one of the contact point metal laminates. Subsequent to use over a period of time, such an insulating convex seat is frictionally damaged with respect to the AC plug insertion and frictional forces cause deformation of the metal laminates, resulting in poor electrical contact.

In such prior art systems, during installation and assembly of such sockets, every contact point metal laminate must align with a corresponding groove and the assembly and installation of such contact point metal laminates is time consuming and difficult to attain. Additionally, to contiguously adhere the insulating convex seats on the metal laminates may cause deformation in the metal laminates due to frictional contact with the AC socket. The displacements and actions resulting in on/off positions of the contact point of such prior art switches is non-accurate and affects the overall AC/DC power supply.

The subject invention is directed to an improved socket switch which relieves the subject socket switch of the shortcomings of prior art systems having a simple, single component system which is able to be assembled conveniently and quickly. Additionally, the subject socket switch is structurally stable with an accurate on/off action not found in prior art systems.

SUMMARY OF THE INVENTION

A socket switch is provided for electrically switching from a first set of contacts to a second set of contacts responsive to the insertion of an electrical plug. There is provided a switch body housing having an opening for insert of the electrical plug and a contact point housing secured to the switch body housing. The contact point housing has an internal chamber formed therein. A rear clamping member is insertable within the contact point housing within the internal chamber. A substantially triangularly contoured switch member is rotatably coupled to the contact point housing and has a first apex extending into the path of the electrical plug when the electrical plug is inserted into the switch body housing. The substantially triangularly contoured switch member has a second apex rotatably displaced from a first position to a second position responsive to the first apex being contacted and rotated by insert of the electrical plug into the opening. A first, second and third set of contact members are fixedly secured to the rear clamping member and extends into the contact point housing for contact with the second apex. The first set of contacts is defined by the first and second contact members and the second set of contacts is defined by the second and third contact members. The first, second and third contact members are secured to the rear clamping member and extend into the internal chamber in displaced overlying relation each with respect to the other. The first, second and third contact members are fixedly secured to a U-shaped fastening member secured to a wall of the rear clamping member. The rear clamping member is secured to the contact point housing by a pair of upper and lower pintle hook members of the contact point housing.

DESCRIPTION OF THE PREFERRED EMBODIMENTS

Figure 1:
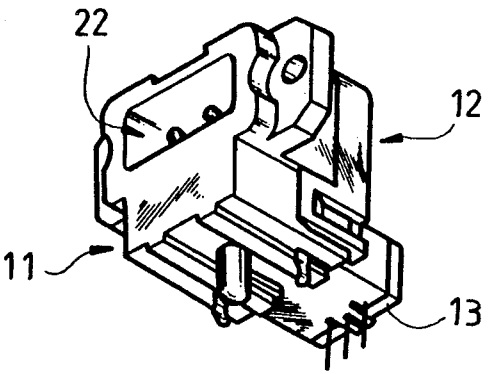
FIG. 1 is a perspective view of the improved socket switch of the present invention.
Figure 2:
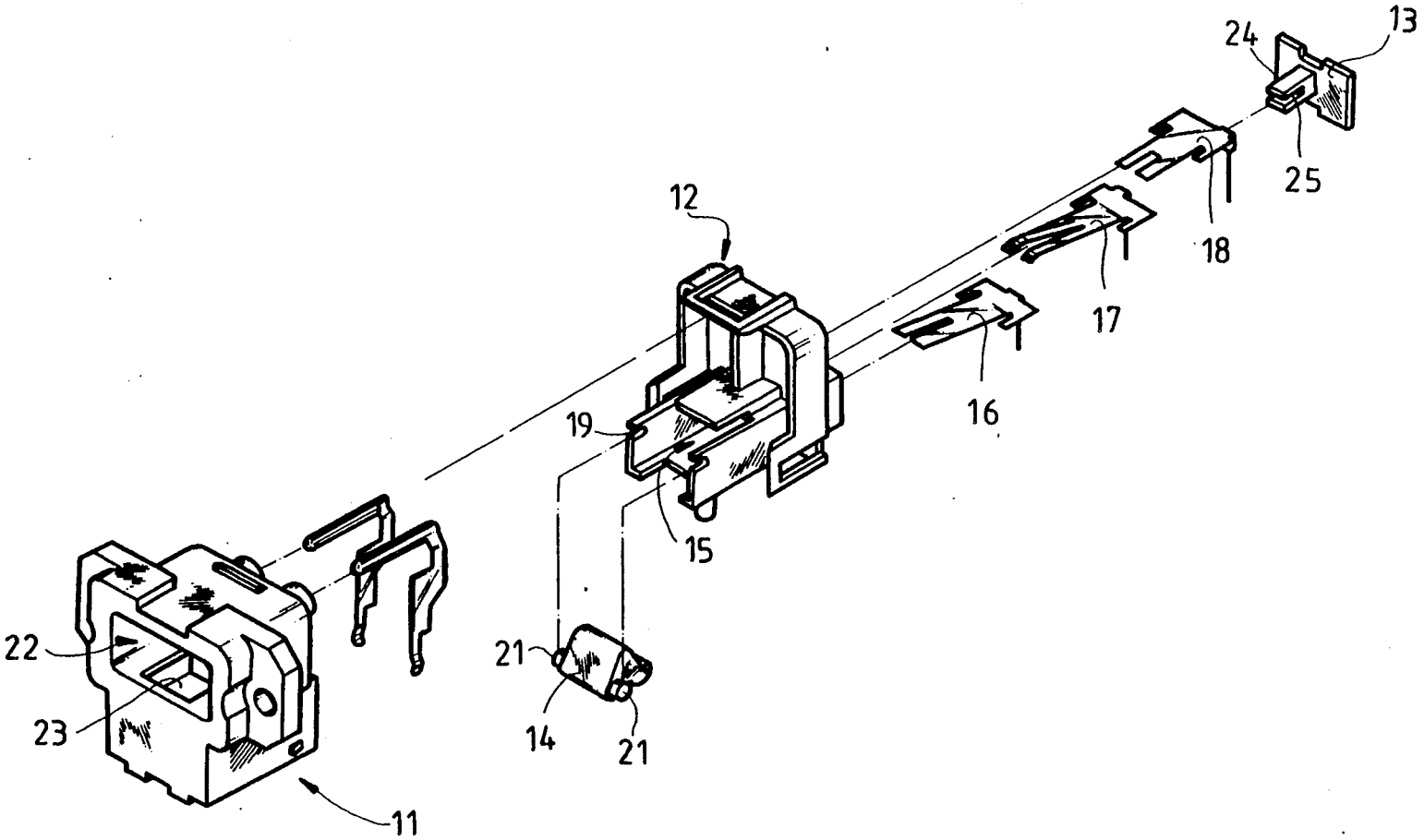
FIG. 2 is a perspective blow-out view of the structure of the subject socket switch.
Figure 4:
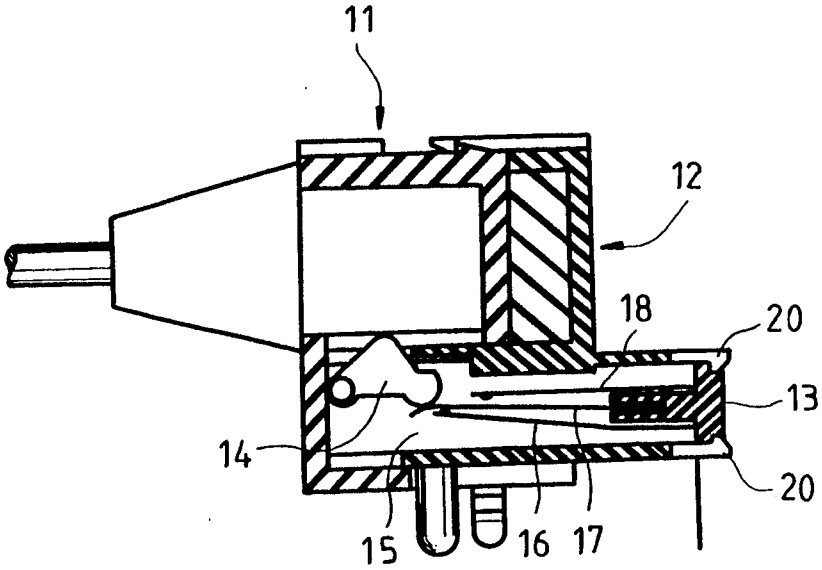
Figure 3:
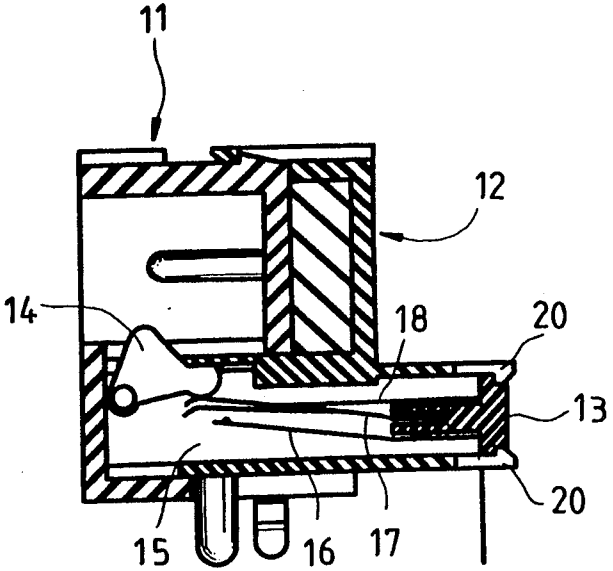
FIG. 3 is an elevational cross-sectional view of the subject socket switch prior to insertion of an AC plug; and, FIG. 4 is an elevational, sectional view of the subject socket switch with the AC plug being inserted.

Referring to FIGS. 1–4, there is shown the improved socket switch of the subject invention. The socket switch includes the body housing 11, the contact point housing 12, and rear clamping member 13. Substantially triangularly contoured switch member 14 is mounted between body housing 11 and contact point housing 12. There is first contact member 18, second contact member 17, and third contact member 16 providing for contact point metal laminates which are clamped and fixed within internal chamber 15 at the bottom of contact point housing 12 by rear clamping member 13, as is clearly seen in FIGS. 3 and 4. First contact member 18 and second contact member 17 form a first set of contacts and second contact member 17 and third contact member 16 form a second set of contacts, as is respectively shown in FIGS. 3 and 4. As can be seen in FIG. 3, when the AC plug is not inserted within the socket switch, first and second contact members 18 and 17 are in contact. As shown in FIG. 4, when the AC plug is inserted within the socket switch, second contact member 17 and third contact member 16 are in contact relation each with respect to the other.

Referring to FIG. 2, internal chamber 15 is seen to be formed at the bottom of the contact point housing. Shaft grooves 19 are formed on opposing sides of contact point housing 12. Upper and lower pintle hook members 20 are formed on the rear end of contact point housing 12 at one end of internal chamber 15, as is shown in FIGS. 3 and 4. Substantially triangularly contoured switch member 14 is shown in FIG. 2 and includes shaft member 21 extending transversely on opposing sides of switch member 14. Shaft members 21 are insertable within shaft grooves 19, as is seen in FIG. 2.

When contact point housing 12 and housing body 11 are secured to each other, shaft grooves 19 allow the insertion of shaft member 21 on opposing sides of switch member 14 and allows switch member 14 to be displaced into the interior of body housing 11. One apex of the triangularly shaped switching member 14 extends beyond internal chamber 15 through groove 23 and into the path of an AC plug being inserted through opening 22 of body housing 11.

Rear clamping member 13 includes a rear wall and a U-shaped fastening member defined by upper and lower arms 24 separated by central groove 25. First contact member 18 is mounted and secured to an upper surface of upper arm 24 and third contact member 16 is mounted to a lower surface of a lower arm of member 24 with second contact member 17 insertably fastened within groove 25. Upon assembly, as is seen in FIGS. 3 and 4, metal laminates or contact members 16, 17, 18 are located within internal chamber 15 at the bottom section of contact point seat housing 12.

Rear clamping member 13 is fastened to contact point housing by interaction of the upper and lower pintle hook members 20 at the open end of the rear portion of internal chamber 15, as is shown in the Figures. Metal laminate or contact members 16, 17 and 18 are fixedly secured within internal chamber 15 through securement to rear clamping member 13.

The positional location of contact members 16, 17 and 18 within internal chamber 15 prior to insert of the AC plug is shown in FIG. 3. Substantially triangularly contoured switch member 14 has a first apex which extends upwardly into the path of the AC plug when the AC plug is inserted within opening 22 of switch body housing 11. Switch member 14 is biased upwardly as shown in FIG. 3 by the elastic contact member 17 which is biased to provide an upward directional force on switch member 14. Contact member 17 and contact member 18 contact each other mutually in this state.

Insertion of AC plug into opening 22 of body 11 is shown in FIG. 4. The plug contacts and presses switch member 14 to cause a second apex to be rotated in a downward direction, as shaft member 21 rotates with respect to the sidewalls of contact point housing 12 within grooves 19. The downward action and displacement results in the contact members 17 and 18 to become separated and contact members 16 and 17 are in contiguous relation to close the circuit and form the action of switching from the first set of contact members to the second set of contact members. When the AC plug is pulled external switch housing 11, member 14 is biased upwardly by the elasticity of the laminate contact member 17 to recover the state of the original closed circuit.

Thus, as described in previous paragraphs, the present invention is constituted by the combination of switch housing 11, contact point housing 12, and rear clamping member 13 where the structure of the overall switch is simplified through the design of the rear clamping member 13 and the pintle hooks 20 of contact point housing 12. In this manner, it is a simple process to insert and secure the contact members 16, 17 and 18 in a convenient and simple manner. Simultaneously, rear clamping member 13 provides the effects of fixedly securing, positioning, separating and insulating. Further, switch member 14 is a single component and does not affect the fastening of the contact point members 16, 17 and 18 and provides for an optimized effect of switching. In practice, assembling the component is simplified and forms a total contact switch to fulfill the purposes described previously.

I claim:

1. A socket switch for electrically switching from a first set of contacts to a second set of contacts responsive to insertion of an electrical plug, comprising:

(a) a switch body housing having an opening for insert of said electrical plug;

(b) a contact point housing secured to said switch body housing, said contact point housing having an internal chamber;

(c) a rear clamping member insertable within said contact point housing within said internal chamber;

(d) a substantially triangularly contoured switch member rotatably coupled to said contact point housing and having a first apex extending into the path of said electrical plug when said electrical plug is inserted into said switch body housing; said substantially triangularly contoured switch member having a second apex rotatably displaced from a first position to a second position responsive to said first apex being contacted and rotated by said insert of said electrical plug into said opening; and, (e) a first, second, and third contact member fixedly secured to said rear clamping member and extending into said contact point housing for contact with said second apex, said first set of contacts defined by said first and second contact members and said second set of contacts being defined by said second and third contact members, said first, second and third contact members being secured to said rear clamping member and extending into said internal chamber in displaced overlying relation each with respect to the other, said first, second and third contact members being fixedly secured to a U-shaped fastening member secured to a wall of said rear clamping member, said rear clamping member being secured to said contact point housing by a pair of upper and lower pintle hook members of said contact point housing.

* * * * *